US012448777B2

(12) United States Patent
Bosteels et al.

(10) Patent No.: US 12,448,777 B2
(45) Date of Patent: Oct. 21, 2025

(54) METHOD FOR PRODUCING A STRUCTURAL ELEMENT, AND A STAIRCASE AND A STRUCTURAL ELEMENT AND A STAIRCASE WHICH HAVE BEEN PRODUCED ACCORDING TO THIS METHOD

(71) Applicant: ECOSOURCEN NV, Temse (BE)

(72) Inventors: Dany Bosteels, Boom (BE); Filip Cordeel, Temse (BE); Floris Bosteels, Boom (BE)

(73) Assignee: ECOSOURCEN NV, Temse (BE)

( * ) Notice: Subject to any disclaimer, the term of this patent is extended or adjusted under 35 U.S.C. 154(b) by 73 days.

(21) Appl. No.: 17/928,119

(22) PCT Filed: May 21, 2021

(86) PCT No.: PCT/IB2021/054427
§ 371 (c)(1),
(2) Date: Nov. 28, 2022

(87) PCT Pub. No.: WO2021/240322
PCT Pub. Date: Dec. 2, 2021

(65) Prior Publication Data

US 2023/0212860 A1 Jul. 6, 2023

(30) Foreign Application Priority Data

May 29, 2020 (BE) ..... 2020/5384

(51) Int. Cl.
*E04F 11/116* (2006.01)
*E04F 11/035* (2006.01)
(Continued)

(52) U.S. Cl.
CPC ..... *E04F 11/116* (2013.01); *E04F 11/035* (2013.01); *E04F 11/108* (2013.01); *E04F 11/112* (2013.01)

(58) Field of Classification Search
CPC ..... E04F 11/09; E04F 11/035; E04F 11/108; E04F 11/112; E04F 11/116; E04F 2011/0212
(Continued)

(56) References Cited

U.S. PATENT DOCUMENTS 1,815,126 A 7/1931 Woolridge
2,154,937 A * 4/1939 Henderson ..... E04F 11/022 52/189
2,915,894 A * 12/1959 Reichert ..... E04F 11/022 D25/68
10,358,827 B1 * 7/2019 Sorenson, Jr. ..... B27M 3/12
(Continued)

FOREIGN PATENT DOCUMENTS

AT 177918 B * 3/1954
AT 183223 B * 9/1955
(Continued)

OTHER PUBLICATIONS

Search Report for International Patent Application PCT/IB2021/054427, mailed on Aug. 5, 2021.

*Primary Examiner* — Christine T Cajilig
(74) *Attorney, Agent, or Firm* — FRESH IP PLC; Clifford D. Hyra; Aubrey Y. Chen

(57) ABSTRACT

Disclosed is a method for producing a structural element by joining together at least two separately produced parts where at least one part is made of concrete by cutting it from a volume of concrete and where all parts extend over the entire length of the structural element; a method for producing a staircase by joining together at least two separately produced staircase parts, which are cut from a volume of material and
(Continued)

extend over the entire length of the staircase, and a structural element and a staircase which have been produced in this way.

57 Claims, 2 Drawing Sheets

(51) Int. Cl.
*E04F 11/108* (2006.01)
*E04F 11/112* (2006.01)

(58) Field of Classification Search
USPC ..... 52/189, 190
See application file for complete search history.

(56) References Cited

U.S. PATENT DOCUMENTS

| | | | | |
|---|---|---|---|---|
| 2008/0115429 | A1* | 5/2008 | Zirbel | E04F 11/02 52/600 |
| 2015/0267408 | A1* | 9/2015 | Kurath-Grollmann | E04C 5/127 52/223.13 |
| 2017/0239838 | A1* | 8/2017 | Eggleston | B28B 7/225 |
| 2018/0100311 | A1* | 4/2018 | Bergmeyer | E04F 11/002 |

FOREIGN PATENT DOCUMENTS

| | | | | |
|---|---|---|---|---|
| DE | 800604 | C * | 11/1950 | |
| EP | 2354366 | A1 | 12/2015 | |
| WO | WO-2007138094 | A1 * | 12/2007 | E04F 11/035 |

* cited by examiner

METHOD FOR PRODUCING A STRUCTURAL ELEMENT, AND A STAIRCASE AND A STRUCTURAL ELEMENT AND A STAIRCASE WHICH HAVE BEEN PRODUCED ACCORDING TO THIS METHOD

FIELD OF THE DISCLOSURE

Firstly, the present disclosure relates to a method for producing a structural element which is assembled by joining together and connecting at least two separately produced parts, whereof at least one is made of concrete.

Secondly, the present disclosure also relates to a structural element comprising at least two separately produced parts, whereof at least one is made of concrete.

BACKGROUND

Concrete structural elements are frequently used in constructions and buildings. They can here have a load-bearing function, such as, for example, girders or supporting columns, but can also be integrated as a non-load-bearing functional and/or aesthetic element in a construction. An example of a non-load-bearing functional and, at the same time, also aesthetic and architecturally important structural element is a concrete staircase.

Concrete structural elements are sometimes produced as one-piece elements made of concrete, so that these are quite bulky and heavy and are consequently also not easily transportable to the place where the construction is erected. In many cases, such a one-piece structural element is only movable with the aid of a crane. In order to remedy this, concrete structural elements are often assembled from a plurality of separately produced concrete parts which are connected to one another on site. Structural elements which have an elongated shape, such as, for example, a supporting column, are assembled from separate parts which butt one against another in the longitudinal direction. From the viewpoint of mechanical load-bearing capacity, a structural element which is interrupted in the longitudinal direction cannot however be readily used in all circumstances. From an aesthetic viewpoint too, such a structural element is less attractive.

If the transverse dimensions of the structural element according to the longitudinal direction vary, such a structural element has a large number of parts having a different shape and/or dimensions. For the production of each different concrete part, there is a need for a wooden formwork which encloses a free space that has exactly the shape and dimensions of the part to be produced. The making of a formwork is very time-consuming and expensive, so that the cost of production of such a structural element is relatively high.

Moreover, the existing methods offer few opportunities to create more variation and aesthetic effects in the look of a structural element.

SUMMARY

It is an object of the present disclosure to remedy these drawbacks by providing a method which are executable at a low production cost, which delivers a structural element that in varying circumstances has a sufficient load-bearing capacity and is easily movable, and which, from an architectural viewpoint, also opens up new opportunities for creating structural elements having an attractive and varied look.

This object is achieved by providing a method for producing a structural element which is assembled by joining together and connecting at least two separately produced parts, whereof at least one is made of concrete, wherein, according to the present disclosure, each concrete part is cut from a volume of concrete by means of a cutting method, and wherein all parts, in the assembled structural element, extend over the entire length of the structural element.

Through the use of a cutting method, it is no longer necessary to make a formwork for each different shape. It is sufficient, for example, to produce a beam-shaped volume of concrete having the thickness of the concrete parts to be produced, and subsequently to cut the concrete parts with the desired shape and dimensions from this volume of concrete, wherein the cut surfaces run perpendicular to the surface of the volume of concrete. This is realizable, for example, by using a water jet cutting method, wherein a jet of liquid containing an abrasive is directed under high pressure at the material to be cut.

A cutting method allows the production of different parts having very differing and mutually different shapes, without this having much effect on the total cost of production of the structural element. This ensures greater freedom in the shaping of structural elements.

For the production of a structural element according to the present disclosure, the structural element is divided into a number of parts to be separately produced. With this division, it is ensured that each part has such a volume and such a weight that it is easily transportable to the construction site and is also easily movable at the construction site itself, for example by virtue of the fact that two persons can easily take up and move each part manually or with simple tools.

The structural element according to the present disclosure then consists of separate parts which are uninterrupted according to the longitudinal direction and extend side by side and are preferably also connected to one another. A structural element of this type has a sufficiently large load-bearing capacity in quite a few applications. Moreover, a structural element of this type has a look which, in comparison with the existing structural elements, is totally new and, from an architectural viewpoint, opens up new opportunities for designing structural elements having an original shape and look.

According to a preferred method, the structural element comprises at least one part which is made of a material other than concrete. As a result, a structural element whose look displays much more variation than the existing structural elements is obtained without any great increase in production cost.

Thus, in one and the same structural element, a portion of the outer surface is formed by the surface of one or more concrete parts, and another portion of the outer surface is formed by one or more parts made of a different material, such as, for example, a stone such as, for example, blue stone or marble, or a different hard material, such as, for example, wood, glass, metal or plastic. Preferred types of wood are meranti, oak, beech, tropical wood varieties, pine, and spruce.

The concrete parts and/or the parts made of a different material preferably have cut surfaces which have a look that is different from their other outer surfaces. A cut surface is a surface of the part which is formed by cutting through the volume of material. In a concrete cut surface, you see the cement with, for example, pieces of darker limestone or smaller, grey pebbles therein. The look of the usual uncut concrete surface is different, because almost exclusively the cement is visible therein. By altering the composition of the concrete, the look of the cut surface is able to be adapted. This can also be realized by adding dyes or coloured components to the concrete. In the case of other materials too, the cut surface will generally have a look which is different from the uncut surface of the material. Thus, in the cut surface of a multiplex board, the different wood veneer layers are differentiated, whilst the usual uncut surface of a multiplex board is formed by the uninterrupted surface of an outermost wood veneer layer.

By, in the use of a water jet cutting method, altering the speed, so that the water jet, during the cutting, advances in relation to the surface of the material (hereinafter 'the cutting speed'), the roughness of the cut surface is influenced. For example, in order to obtain a rather rough anti-slip surface, a stone or concrete shall be cut at quite a high speed. In the case of glass or a different transparent material, the rougher cut surface will result in light transmitted via the cut surface being distributed differently in comparison with light transmitted via an uncut glass surface. This also applies to light that reflects onto a rougher cut surface.

Preferably, at least one part, preferably each part, comprises two flanks extending according to the longitudinal direction of the structural element and having a varying transverse dimension. This transverse dimension is the dimension of a flank, measured in the plane of the flank in a direction which runs perpendicular to the longitudinal direction of this flank. By adapting the transverse dimension of the parts, the transverse dimension of the entire structural element is able to be determined. This allows the dimensions of a structural element to be adapted very precisely to the anticipated loads upon it. Thus, a supporting column is produced with transverse dimensions which vary according to the length of the supporting column in accordance with the longitudinally varying load upon the supporting column (on the basis of strength calculations). A situation in which structural elements, over a portion of their length, are over-dimensioned, and thus contain too much material and are too heavy, is hereby avoided.

Preferably, at least one part, preferably each part, comprises a surface which runs visibly on the surface of the structural element and which is a partial surface of the outer surface of the structural element. That partial surface traverses, preferably uninterruptedly, the entire length of the structural element. The surface which runs visibly on the surface of the structural element is preferably a cut surface.

In most cases, a cut surface has a look different from that of another surface which is not the result of cutting. This means that a part which comprises at least one cut surface and at least one uncut surface, as a result of the adopted production method, has surfaces having a mutually different look. This ensures additional variation in the look of the structural element. Through the use of parts made of very different materials, the side-by-side running partial surfaces which are formed by surfaces of these parts and run visibly on the surface of the structural element also have a very different look. Through the combination of different materials, with their very different structures and colours, a very varied look of the structural element is obtained.

As a result of the large number of different possible combinations of diverse materials and the much greater scope of design in the shaping of structural elements, original structural elements having very differing looks and surprising visual effects are created.

In a preferred method, all joined-together parts together form the entire structural element. The parts are preferably also mutually connected to one another, so that the assembled structural element is a rigid entity. The mutual connection between the different slices are realized both mechanically and by means of a bonding agent such as, for example, a glue.

In a particularly preferred method, the assembled structural element has an elongated shape and the structural element has a cross section which varies according to the longitudinal direction. This means that successive cross sections of the structural element, perpendicular to the longitudinal direction, have a mutually different shape and/or dimension.

Each part of the structural element has, for example, two practically flat flanks and is a slice of the structural element, which slice extends according to the longitudinal direction. Preferably, all parts together form the entire structural element. The said flanks are preferably located in parallel planes.

By the expression 'that each part is a slice of the structural element' is meant that each part, analogously to the slice of a loaf, has two flat flanks and a transverse surface extending transversely to the flanks, wherein the transverse surface connects the two flanks one to the other and follows the circumference of the part, and that each part, as it were, is a cut-off portion of the structural element according to a cutting plane which intersects the structural element. This cutting plane preferably extends according to the longitudinal direction of the structural element. Preferably, all different parts together form the entire structural element.

In a structural element of this type, assembled from a row of two or more parts which are placed with their flanks one against another, the outer surface of the structural element is formed by a flank of the first part, a flank of the last part, and the mutually abutting transverse surfaces of the different parts of the row, analogously to the manner in which the slices of a loaf, butting one against another, form the outer surface of the loaf. The transverse surface of each part is then visible on the outer surface of the structural element as a continuous partial surface, running over the circumference of the structural element, of that outer surface.

If a part is cut from a concrete block having two parallel surfaces, a cut is preferably made in a direction which runs perpendicular to the said parallel surfaces, so that the cut-out part has two parallel flanks whereof the shape is determined by the line according to which the part has been cut out, and whereof the surface initially constituted part of the parallel surfaces of the concrete block. Accordingly, each part has a cut surface, directed perpendicular to the flanks, which is a transverse surface of the part that mutually connects both flanks.

According to a preferred method, the structural element comprises at least one part made of one of the following materials: a stone such as, for example, marble or blue stone, wood, a wood-based material such as, for example, multiplex, glass, plexiglass, metal, or a plastic.

Preferably, the structural element comprises at least one part made of a transparent material, such as, for example, glass.

Thus, with the incident light that falls on the part made of transparent material and is transmitted through the transparent material and leaves the transparent part via a surface which runs on the outer surface of the structural element, a lighting effect is created in the surface of the structural element. This light is both natural light and light deriving from a light source provided for this purpose. Thus, a light-emitting surface is formed in the surface of the structural element. This surface can have a limited length or can extend over the entire length of the structural element. This light-emitting surface has, for example, the shape of a narrow strip or a line. This lighting effect is used as a signalling means to indicate, for example, a safe running direction in an unlit or dimly lit environment.

The light is preferably transmitted via a cut surface of a part made of transparent material. Since the roughness of the cut surface influences the light distribution, and thus also the lighting effect, the roughness is determined as a function of the desired lighting effect. As stated earlier, the roughness is influenced by altering the speed in the use of a water jet cutting method. The roughness is not necessarily the same over the entire length of the cut surface of a part, but can also be varied in order to create, with one and the same transparent part, at least two mutually different lighting effects.

The parts are preferably connected to one another by means of a mechanical connecting element and/or a chemical bonding agent, such as a silicon-based copolymer or an epoxy glue or a polyurethane glue.

The mechanical connecting element is, for example, a rod-shaped element which extends through openings in two or more parts of the structural element, preferably in a direction which runs almost perpendicular to the planes in which the flanks of the parts are found.

The said cutting method which is used to cut out each concrete part is preferably a water jet cutting method, preferably a water jet cutting method using an abrasive.

A water jet cutting machine uses water under high pressure—to which abrasive particles, such as quartz sand or garnet, are added. These abrasive particles are added in a spray head to the water. In this process, the cutting is actually carried out by these abrasive particles. The water then serves to lend these particles sufficient speed to cut effectively and to guide the particles accurately in the direction of the cutting point. The effectiveness of the cutting process is further improved by increasing the water pressure, so that the water and the particles move faster. Also the flow velocity of the water and the particles is increased, so that the particles hit the material harder. The rate at which the spray head advances in relation to the surface of the material to be cut is determined as a function of the processability of the material and as a function of the desired look of the cut surface.

Furthermore, it is also preferable to produce each part which is not made of concrete also by the use of a cutting method, such as, for example, a laser cutting method, a plasma cutting method or a water jet cutting method, or with the aid of a CNC machine.

Water jet cutting can also be realized without the addition of abrasive particles. In this case, the material is exclusively penetrated by the pressure and velocity of the water itself. In laser cutting, a material is cut contactlessly by melting, combustion or vaporisation of the material along the cutting line with a laser. In cutting with a plasma cutter, plasma is heated to the point of ionisation, whereafter it is electrically conductive. A plasma cutter can hence cut any material which is electrically conductive, such as most metals. Gas is pushed through the nozzle of the plasma machine, whereafter the plasma is exposed to an electric arc, so that a plasma jet is generated. The very high temperatures of the plasma subsequently melt the plasma, so that a so that a slice is formed.

According to a particularly preferred method, the structural element is a staircase, wherein at least each concrete part has a cut surface which is located on the upwardly directed surface (the side where the tread surface of the steps is found when the staircase is placed in a usage position).

Preferably, the structural element is a staircase having first surfaces which form the steps and second surfaces which extend between the levels of the steps, so that these first and second surfaces together form a mainly closed surface, in particular a staircase which is denoted by the term 'closed staircase'.

Preferably, all parts of the staircase are produced with a cutting method and all parts have a cut surface which is located on the upwardly directed surface of the staircase.

According to the present disclosure, a staircase can also be assembled from mutually connected parts which are kept at a distance apart by means of one or more spacers. Between the flanks of the parts there is then provided a narrow open passage. In the case of an external staircase, for example, the passage is very useful for the drainage of rainwater. This passage also ensures that the staircase acquires a more open structure. This passage also admits light, so that this is useful for illuminating the space above the staircase by means of incident light which falls on the underside of the staircase. With this light, lighting effects can also be created.

The weight of each part is preferably no higher than 80 kg, more preferably no higher than 60 kg, and most preferably no higher than 50 kg. Such a part is moved using simple tools, or manually by two persons.

For specific applications and loads, a structural element according to the present disclosure is produced, in which between at least two concrete parts is provided a metal part. The metal part is connected to the two neighbouring concrete parts, so that the metal acts as a sort of reinforcement in the structural element. Moreover, metal has the advantage of being readily recyclable.

A structural element of this type is also readily recyclable as a whole, wherein the metal part is easily separated from the concrete parts, and wherein both the metal and the concrete is easily recycled so as to be reused for the production of new structural elements.

In order to realize the earlier indicated objects of the present disclosure, there is also provided a structural element comprising at least two separately produced and mutually connected parts, whereof at least one is made of concrete, wherein, according to the present disclosure, each concrete part is cut from a volume of concrete by means of a cutting method, and all parts, in the assembled structural element, extend over the entire length of the structural element.

The advantages of such a structural element according to the disclosure and the manner in which the earlier indicated objects of the present disclosure are obtained are directly derived from the above description of the method for producing a structural element having the indicated characteristics.

Other particular characteristics of the structural element are stated in claims 15 to 23 and in the above description. The advantages and effects of these characteristics can also be directly derived from the above description of the advantages and effects of the corresponding characteristics of the method for producing such a structural element.

On the other hand, the present disclosure also relates to a method for producing a staircase which is assembled by joining together and connecting at least two separately produced staircase parts.

Staircases are produced from diverse materials, such as wood or glass or concrete or a stone, such as, for example, a natural stone, for example blue stone or marble. Where a staircase is produced as a one-piece structural element, then this is often a quite bulky and heavy structural element, which is not easily transportable to the place where the construction is erected. In many cases, for the placement of a staircase, a crane is also necessary. Hence the operations proceed rather slowly and are also relatively dangerous, and the risk of damage to the staircase is quite high.

Some staircases are assembled in situ from various separately supplied components which, one by one, are connected to one another successively according to the longitudinal direction of the staircase. This method is quite time-consuming and laborious. For the forming of concrete staircase parts, a formwork has to be made. The separate production of the numerous components is expensive and time-consuming. Moreover, the existing structure of a staircase offers few opportunities for the creation of staircases having a more varied look, which staircases are produced easily and at an acceptable production cost and are easily put in place.

A second object of the present disclosure is also to remedy these drawbacks.

This object is achieved by providing a method for producing a staircase which is assembled by joining together and connecting at least two separately produced staircase parts, wherein, according to the present disclosure, each staircase part is cut from a volume of material by means of a cutting method, and all staircase parts, in the assembled staircase, extend over the entire length thereof.

Preferably, the assembled staircase is a staircase having first surfaces which form the steps and second surfaces which extend between the levels of the steps, so that these first and second surfaces together form a mainly closed surface, in particular a staircase which is denoted by the term 'closed staircase'.

The number of staircase parts which must be produced and must be joined together in situ can hereby be considerably reduced. Staircases having complex shapes are assembled from a relatively small number of relatively quickly producible staircase parts, which extend over the entire length of the staircase. The staircase parts are cut out, for example, from a volume of material having a uniform thickness, wherein the cutting-out is realized by cutting through the material over its full thickness. The top side and bottom side of the volume of material then form the flanks of a staircase part having a shape defined by the cutting line, and the cut surfaces directed perpendicular to the flanks form a transverse surface which extends around the staircase part and connects the flanks to one another.

Through the use of cutting method, it is no longer necessary to make a formwork for the production of concrete staircase parts.

The cutting-out is realized, for example, by means of a plasma cutting method or a laser cutting method, or by means of a CNC machine. Preferably, use is made of a device with which the cutting is controlled automatically. This can also be realized, inter alia, by the use of a water jet cutting method, wherein a jet of liquid containing an abrasive is directed under high pressure at the material to be cut.

The various parts can here form very differing and mutually different shapes, without this having much effect on the cost of production of the structural element. An architect or a designer hence has greater freedom in the shaping of the staircase.

A staircase according to the present disclosure then consists of separate parts which are interrupted according to the longitudinal direction and extend side by side and are preferably also connected to one another. Such a staircase has a sufficiently high load-bearing capacity. Moreover, such a staircase has a look which, in comparison with the existing staircases, is entirely new and, from an architectural viewpoint, opens up new opportunities to design staircases having an original shape and look.

The separately produced parts are easily transported to the place where they have to be accommodated in the construction, and the staircase is assembled in situ by joining together the parts and connecting them to one another. The separate staircase parts are constructed with such a thickness that the volume and weight thereof allow an easy transport and a comfortable placement. Preferably, the weight and volume of each slice is such that two persons can carry each staircase part easily and safely without tools, or with simple tools, and can place them at the location where they have to be integrated into the construction.

According to the present disclosure, a staircase can also be assembled from mutually connected parts which are kept at a distance apart by means of one or more spacers. Between the flanks of the parts there is then provided a narrow open passage. In the case of an external staircase, for example, the passage is very useful for the drainage of rainwater. This passage also ensures that the staircase acquires a more open structure. This passage also admits light, so that this is useful for illuminating the space above the staircase by means of incident light which falls on the underside of the staircase. With this light, lighting effects can also be created.

The staircase is preferably assembled by placing the staircase parts with their flanks one against another in practically vertical planes, wherein the cut surfaces form the top surface and the bottom surface of the staircase. The staircase parts can also be fastened side by side at a distance apart, wherein a spacer is provided between each two neighbouring staircase parts. The staircase parts can then be connected to one another, for example, by a mechanical fastening means, such as a rod-shaped element which extends through a transverse opening perpendicular to the flanks in each staircase part.

A cut surface is obtained by the cutting of the material. In most cases, a cut surface has a look different from another surface which is not the result of cutting. This means that a staircase part comprising at least one cut surface and at least one uncut surface, as a result of the adopted production method, has surfaces having a mutually different look. This ensures additional variation in the look of the staircase.

In a preferred method, all joined-together staircase parts together form the entire staircase. The staircase parts are also mutually connected to one another, so that the assembled staircase is a rigid entity, wherein all staircase parts are preferably hard materials. The mutual connection between the different staircase parts are realized both mechanically and by means of a bonding agent such as, for example, glue.

Preferably, staircase parts which have two flanks extending according to the longitudinal direction of the staircase are provided. Each staircase part then preferably has two practically flat flanks, so that each staircase part is a slice of the staircase, which slice extends according to the longitudinal direction. Preferably, all parts together form the entire structural element. The said flanks are preferably located in parallel planes.

By the expression 'that each staircase part is a slice of the staircase' is meant that each staircase part, analogously to the slice of a loaf, has two flat flanks and a transverse surface extending transversely to the flanks, wherein the transverse surface connects the two flanks one to the other and follows the circumference of the staircase part, and that each part, as it were, is a cut-off portion of the staircase according to a cutting plane which intersects the staircase. This cutting plane preferably extends according to the longitudinal direction of the staircase. Preferably, all different parts together form the entire staircase.

In such a staircase, which is assembled from a row of two or more staircase parts which are placed with their flanks one against another, the outer surface of the staircase is formed by a flank of the first staircase part, a flank of the last staircase part and the transverse surfaces of the various staircase parts of the row, analogously to the manner in which the slices of a loaf, butting one against another, form the outer surface of the loaf. The transverse surface of each staircase part is then, on the outer surface of the staircase, visible as a continuous partial surface, running over the circumference of the staircase, of that outer surface.

If a staircase part, for example, is cut from a volume of wood having two parallel surfaces, a cut is preferably made in a direction which runs perpendicular to the said parallel surfaces, so that the cut-out staircase part has two parallel flanks whereof the shape is defined by the cutting line according to which the staircase part is cut out and whereof the surface initially constituted part of the parallel surfaces of the volume of wood. Each staircase part accordingly has a cut surface, directed perpendicular to the flanks, which is a transverse surface of the part that mutually connects both flanks.

Preferably, the entire transverse surface of each staircase part is visible on the outer surface of the staircase. The transverse surface then forms on all sides of the outer surface of the staircase, and thus also on the top side of the staircase, a partial surface of the outer surface of the staircase. The mutually abutting transverse surfaces of the different parts then together form the entire uppermost surface of the staircase.

According to a very preferred method, the staircase is assembled from staircase parts made of different materials, wherein the staircase comprises staircase parts made of two or more of the following materials: concrete, a stone such as, for example, marble or blue stone, a wood or wood-based material such as, for example, multiplex, glass, plexiglass, metal, or a plastic. Preferred types of wood are meranti, oak, beech, tropical wood varieties, pine, and spruce.

The staircase parts extend over the entire length of the structural element. Each staircase part preferably also has a surface which runs visibly on the uppermost surface of the staircase and is a partial surface which traverses uninterruptedly the entire length thereof.

Through the use of staircase parts made of very different materials, these partial surfaces, which are visible as side-by-side running strips on the surface of the staircase, also have a very different look. Through the combination of different materials with their typical look and structure, a very varied look is obtained. Moreover, with staircase parts made of transparent materials, lighting effects can also be created in the surface of the staircase.

As indicated earlier, a narrow open passage can also be provided between the flanks of the parts by means of spacers. This passage also ensures that the staircase acquires a more open structure. This passage also admits light, whereby this is useful for illuminating the space above the staircase by means of incident light which falls on the underside of the staircase. With this light, lighting effects can also be created.

As a result of the large number of different possible combinations of diverse materials and the greater scope of design in the shaping of staircases, original staircases with very differing looks and surprising visual effects are created.

Thus, one or more parts made of a first sort of concrete is combined with one or more parts made of a different sort of concrete, wherein both sorts of concrete, for example by virtue of their composition or the addition of a dye, have a different look. In one and the same staircase, one or more concrete parts can also be combined with one or more parts made of a stone, such as, for example, blue stone or marble. The staircase can also comprise one or more staircase parts made of other materials, preferably including hard materials such as, for example, wood, glass, metal or plastic. The staircase can also be assembled from two or more staircase parts made of the same material, for example concrete, wood, wood-based material, stone, glass, plastic or metal.

One or more staircase parts preferably comprise a cut surface which has a look different from their other surfaces. In the look of the concrete cut surface, you can see the cement with therein defined components, such as, for example, pieces of darker limestone or smaller grey pebbles. The look of the usual uncut concrete surface is different because almost exclusively the cement is seen therein. By altering the composition of the concrete, the look of the cut surface is able to be adapted. This can also be realized by adding dyes or coloured components to the concrete. In the case of other materials too, the cut surface will generally have a look different from the uncut surface of the material. Thus, in the cut surface of a multiplex board, the different wood veneer layers are distinguished, whilst the usual uncut surface of a multiplex board is formed by the uninterrupted surface of an outermost wood veneer layer.

These cut surfaces are preferably visible on the top surface of the staircase, being the surface which, after installation of the staircase, is found on the top side.

In the case of glass, the cut surface also has a look different from the usual uncut glass surface, because the cut surface is somewhat rougher than the normal glass surface. This rougher surface ensures a different distribution of the light.

In the use of a water jet cutting method, by altering the rate at which the water jet advances in relation to the surface of the different material in the course of the cutting (hereinafter 'the cutting speed'), the roughness of the cut surface is influenced. For example, in order to obtain a rather rough anti-slip-surface, a stone or concrete is cut at quite a high speed. In the case of glass or a different transparent material, the rougher surface of the cut surface will result in light which is transmitted via the cut surface being distributed differently in comparison with light which is transmitted via an uncut glass surface. This also applies to light which reflects onto a rougher cut surface.

According to a particularly advantageous method according to the present disclosure, the assembled staircase comprises at least one staircase part made of a transparent material.

Thus, with the incident light which falls on the staircase part made of transparent material and is transmitted through the transparent material and leaves the transparent part via a surface which runs on the outer surface of the staircase, a lighting effect is created in the surface of the staircase. This light is both natural light and a light deriving from a light source provided for this purpose. This light source is located, for example, under the staircase. Thus, in the top surface of the installed staircase, a light-emitting surface is formed. This surface can have a limited length or can extend over the entire length of the staircase. This light-emitting surface has, for example, the shape of a narrow strip or a line. This lighting effect is used as a signalling means, in order, for example, to indicate a safe running direction in an unlit or dimly lit environment, and/or as a means of indicating the steps more clearly in order, inter alia, to increase the safety of use of the staircase.

The light is preferably transmitted via a cut surface of a part made of transparent material. Since the roughness of the cut surface influences the light distribution, and thus also the lighting effect, the roughness is determined as a function of the desired lighting effect. As stated earlier, the roughness is influenced by altering the speed in the use of a water jet cutting method. The roughness is not necessarily the same over the entire length of the cut surface of a part, but can also vary in order to create, with one and the same transparent part, at least two mutually different lighting effects.

Alternatively or additionally, open passages are created between the staircase parts by means of spacers in order in this way to admit incident light which falls on the underside of the staircase. The space above the staircase can herewith be illuminated and/or lighting effects can also be created.

The different staircase parts are preferably connected to one another by means of a mechanical connecting element and/or a chemical bonding agent, such as a silicon-based copolymer or an epoxy glue or polyurethane glue. The bonding agent is preferably provided between the flanks of neighbouring staircase parts.

The mechanical connecting element is, for example, a rod-shaped element which extends through openings in two or more parts of the structural element, preferably in a direction which runs practically perpendicular to the planes in which the flanks of the parts are located.

According to a very preferred method, each staircase part is produced by means of a cutting method, such as, for example, a laser cutting method, a plasma cutting method or a water jet cutting method.

A water jet cutting machine uses water under high pressure—to which abrasive particles such as quartz sand or garnet are added. These abrasive particles are added in a spray head to the water. In this process, the cutting is actually executed by these abrasive particles. The water then serves to lend these particles sufficient velocity to make an effective cut and to direct the particles accurately in the direction of the cutting point. The effectiveness of the cutting process is further improved by increasing the water pressure, so that the water and the particles move faster. The flow velocity of the water and the particles can also be increased, so that the particles hit the material harder. The rate at which the spray head advances in relation to the surface of the material to be cut (the speed) is determined as a function of the processability of the material and as a function of the desired look and desired quality of the cut surface.

Water jet cutting can also be realized without the addition of abrasive particles. In this case, the material is exclusively penetrated by the pressure and velocity of the water itself. In laser cutting, a material is cut contactlessly by melting, combustion or vaporisation of the material along the cutting line with a laser. In the case of cutting with a plasma cutter, plasma is heated to the point of ionisation, whereafter it is electrically conductive. A plasma cutter can hence cut any material which is electrically conductive, such as most metals. Gas is pushed through the nozzle of the plasma machine, whereafter the plasma is exposed to an electric arc, so that a plasma jet is generated. The very high temperatures of the plasma subsequently melt the metal, so that it is cut.

According to a most advantageous embodiment, at least one staircase part, preferably each staircase part, comprises a surface which, in the assembled staircase, runs visibly on the surface of the staircase and is a partial surface of the outer surface of the staircase. This partial surface preferably traverses uninterruptedly the entire length of the staircase. The surface which runs visibly on the surface of the staircase is preferably a cut surface of the staircase part. The surface runs preferably visibly on a top surface of the staircase. With the term 'top surface', reference is here made to that surface of the staircase that, in a usage position, is found on the top side of the staircase, on the side of the tread surface of the steps.

Through the use of staircase parts made of very different materials, the side-by-side running partial surfaces which are formed by surfaces of these staircase parts and run visibly on the surface of the staircase also have a very different look. Through the combination of different materials, with their very different structures and colours, a very varied look of the staircase is obtained.

In order to obtain a very easily transportable and placeable staircase, separate staircase parts are preferably produced with a weight of each being no higher than 80 kg, more preferably no higher than 60 kg, most preferably no higher than 50 kg. A staircase part of this type is moved with simple tools, or manually by two persons.

A particular method according to the present disclosure herein consists in the fact that between at least two concrete staircase parts is provided a metal staircase part. The metal part is connected to the two neighbouring concrete parts, whereby the metal acts as a sort of reinforcement in the structural element. Moreover, metal has the advantage of being readily recyclable.

In order to realize the earlier indicated objects, a staircase comprising at least two separately produced staircase parts is also provided, wherein, according to the present disclosure, each staircase part has been cut from a volume of material by means of a cutting technique, and wherein all staircase parts, in the assembled staircase, extend over the entire length thereof.

The advantages of such a staircase according to the disclosure and the manner in which the earlier indicated objects of the present disclosure are obtained are directly derived from the above description of the method for producing a staircase having the indicated characteristics.

Other particular characteristics of the staircase are stated herein. The advantages and effects of these characteristics can also be directly derived from the above description of the advantages and effects of the corresponding characteristics of the method for producing such a staircase.

The disclosure is now explained more closely on the basis of the hereinafter following more detailed description of a possible method for producing and positioning a staircase according to the present disclosure.

It is here emphasized that both the adopted method and the produced structural element are only an example of the general principle of the disclosure and can thus in no way be regarded as a limitation of the scope of protection, nor of the field of application, of the disclosure.

BRIEF DESCRIPTION OF THE DRAWINGS

In this description, reference is made by means of reference numerals to the accompanying figures, whereof

DETAILED DESCRIPTION

Figure 1:
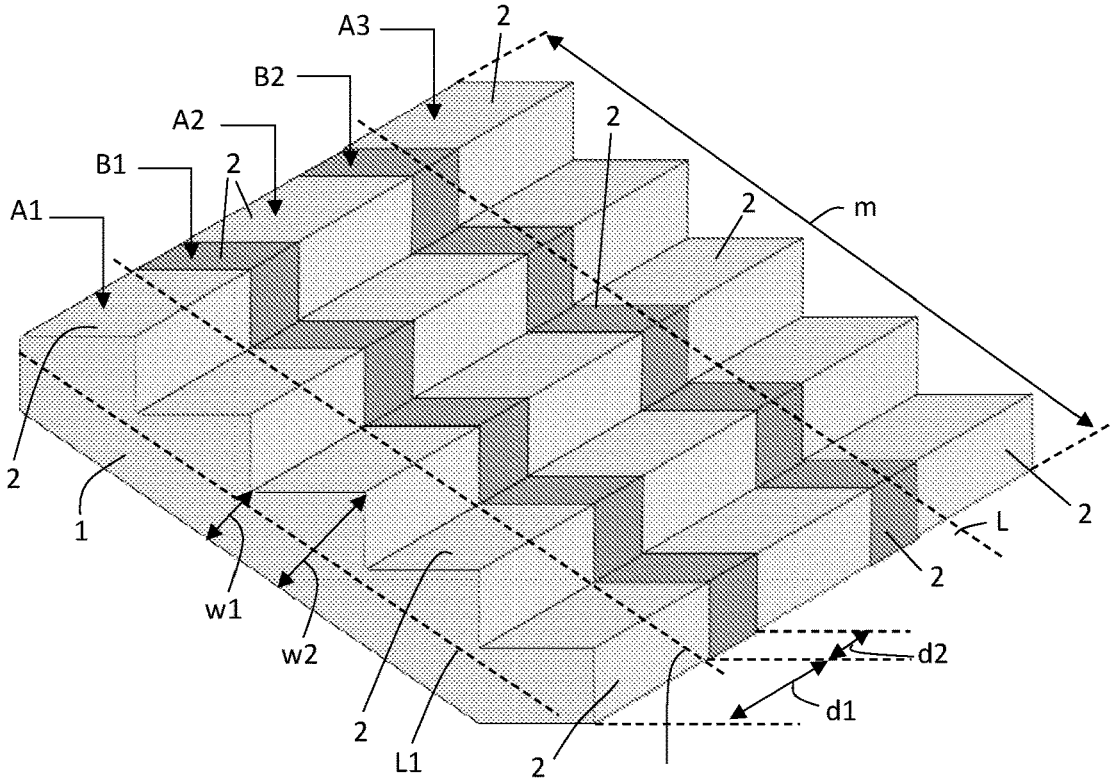
FIG. 1 shows a closed staircase having five steps assembled from three concrete staircase parts and two marble staircase parts, in perspective view.

The staircase represented in FIG. 1 is a closed staircase having five steps and assembled from three identical staircase parts (A1), (A2), (A3) made of concrete and two identical staircase parts (B1), (B2) made of marble. All staircase parts are those cut out of a volume of material by means of a water jet cutting method using quartz sand. The concrete staircase parts (A1), (A2), (A3) are cut from a beam-shaped concrete block having two parallel surfaces which are distanced apart with a spacing (d1). The material is here cut through over the full thickness (d1) in a direction perpendicular to the parallel surfaces.

The marble staircase parts (B1), (B2) have been cut from a beam-shaped block of marble having two parallel surfaces which are distanced apart with a spacing (d2). The material is here cut through over the full thickness (d2) in a direction perpendicular to the parallel surfaces.

Each staircase part consequently has two identical flat flanks (1), which extend parallel to one another, and a transverse surface (2), which is directed perpendicular to these flanks (1) and is obtained by cutting the staircase part from the volume of material and in this patent application is referred to as a cut surface. The transverse surface (2) encloses each staircase slice and defines the shape thereof. On the one side, the transverse surface (2) forms five steps consisting of surfaces which adjoin one another at a right angle and, on the other side, a flat wall. All staircase parts have a practically identical cross section according to the longitudinal direction (L). The flanks (1) of each staircase part (A1), (A2), (A3), (B1), (B2) have a transverse dimension (w1), (w2) perpendicular to the longitudinal direction (L1) which varies according to the longitudinal direction (L1) of the flank (1).

The concrete staircase parts (A1), (A2), (A3) have a weight of 80 kg and the marble staircase parts (B1), (B2) have a weight of 40 kg, so that these are easily movable by two persons.

The staircase parts (A1), (A2), (A3), (B1), (B2) are placed side by side at the construction site by two persons, wherein, alternately, a concrete staircase slice and a marble staircase slice is provided. The width (d1) which is occupied by the concrete staircase parts (A1), (A2), (A3) is wider than the width (d2) which is occupied by the marble staircase parts (B1), (B2). After a polyurethane glue has been applied to the flanks (1), the staircase parts (A1), (A2), (A3), (B1), (B2) are installed with the flanks (1) one against another, wherein they are firmly connected to one another by the glue to form a rigid and stable entity. In the thus assembled staircase, all staircase parts (A1), (A2), (A3), (B1), (B2) extend according to the longitudinal direction (L) of the staircase over the entire length (m) thereof. Finally, the staircase is also at the top and bottom anchored and integrated into the surrounding structure of the building.

The transverse surfaces (2) of the different staircase slices (A1), (A2), (A3), (B1), (B2) here form uninterrupted strips which extend, side by side and butting one against another, on the top side and underside of the staircase over the entire length (m) of the staircase. Through the combination of visible transverse surfaces (2) of the concrete staircase parts, alternated with visible marble transverse surfaces (2), wherein concrete and marble, with their respective typical surface structure and colour, form an attractive contrast, a staircase having a particularly original and varied look is obtained. The transverse surfaces (2) of the staircase parts are cut surfaces and consequently have a look different from the concrete surface of the flanks (1), which surfaces are not a cut surface, thereby ensuring an additional variation in the look of the staircase.

Figure 2:
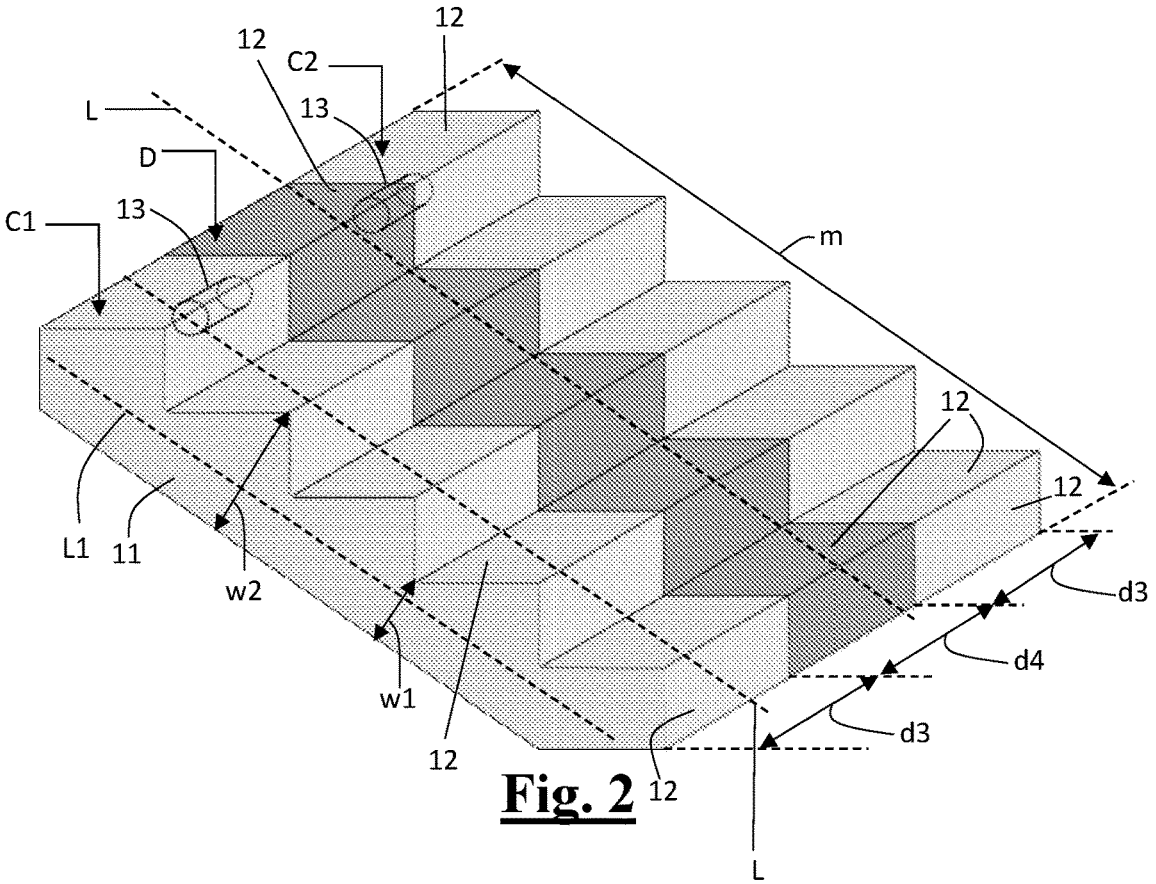
FIG. 2 shows a closed staircase having five steps assembled from two concrete staircase parts and one wooden staircase part, in perspective view.

The staircase represented in FIG. 2 is a closed staircase having five steps, assembled from two identical staircase parts (C1), (C2) made of concrete and one staircase part (D) made of oak wood. The concrete staircase parts (C1), (C2) have been cut out of a beam-shaped volume of concrete, having a uniform thickness (d3), by means of a water jet cutting method using quartz sand.

The wooden staircase part (D) has been cut from a beam-shaped volume of oak wood, having a uniform thickness (d4), by means of a water jet cutting method using quartz sand. The thickness (d3) of the volume of concrete and the thickness (d4) of the volume of oak wood are practically equal. The material is here cut through over the full thickness (d3), (d4) in a direction perpendicular to the parallel surfaces which delimit the volume of material.

Each staircase part (C1), (C2), (D) has an identical cross section in the longitudinal direction (L) and has two identical flat flanks (11), which extend parallel to one another, and a transverse surface (12)—a cut surface—directed perpendicular to these flanks (11), which, on the one side, forms five steps consisting of surfaces which adjoin one another at a right angle and, on the other side, a flat wall.

The flanks (11) of each staircase part (C1), (C2), (D) have a transverse dimension (w1), (w2), perpendicular to the longitudinal direction (L1), which varies according to the longitudinal direction (L1) of the flank (11).

The staircase parts (C1), (C2) made of concrete have a weight of 50 kg and the staircase part (D) made of oak wood has a weight of 20 kg, so that these are easily movable by two persons.

The staircase parts (C1), (C2), (D) are placed side by side at the construction site by two persons, with the flanks (11) butting one against another. The wooden staircase slice (D) is here located centrally between the two concrete staircase parts (C1), (C2). The concrete staircase parts (C1), (C2) and the wooden staircase part (D) have practically the same width (d3), (d4). The staircase parts (C1), (C2), (D) are firmly connected to one another at the installation site by means of an epoxy glue, to form a rigid and stable entity. Alternatively or additionally, the staircase parts are connected to one another by mechanical connecting elements (13) extending through openings (14) in the flanks of the staircase parts (C1), (C2), and (D), as shown schematically in FIGS. 2-3. In the thus assembled staircase, all staircase parts extend according to the longitudinal direction (L) of the staircase over the entire length (m) thereof. Finally, the staircase is also at the top and bottom anchored and integrated into the surrounding structure of the building.

The transverse surfaces (12) of the different staircase parts (C1), (C2), (D) here form uninterrupted strips, which extend, side by side and butting one against another, on the top side and underside of the staircase over the entire length (m) of the staircase. Through the combination of visible transverse surfaces (12) made of concrete and the visible transverse surface (12) made of oak wood, wherein concrete and oak wood form with their respective typical surface structure and colour a surprisingly fine combination, a staircase having a particularly original and varied look is obtained. The transverse surfaces (12) of the staircase parts (C1), (C2), (D) are cut surfaces and consequently have a look different from the concrete surface of the flanks (11), which surfaces are not a cut surface, thereby ensuring an additional variation in the look of the staircase.

Figure 3:
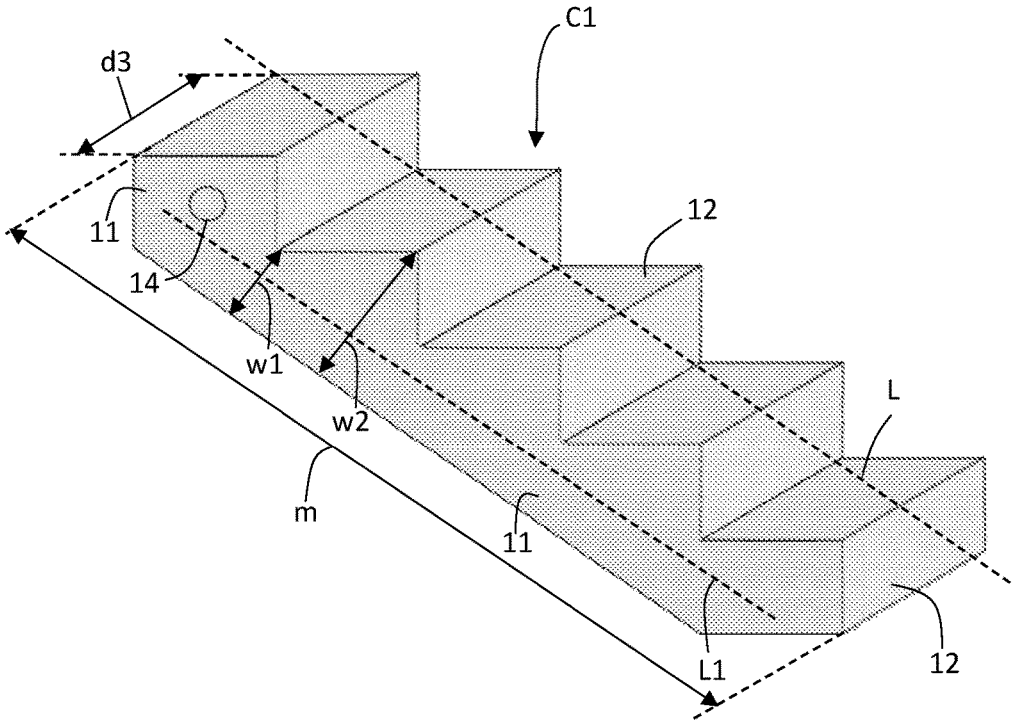
FIG. 3 shows the concrete staircase part of the three-part staircase of FIG. 2, in perspective view.

In FIG. 3 is represented only one of the concrete staircase parts (C1) of FIG. 2.

Figure 4:
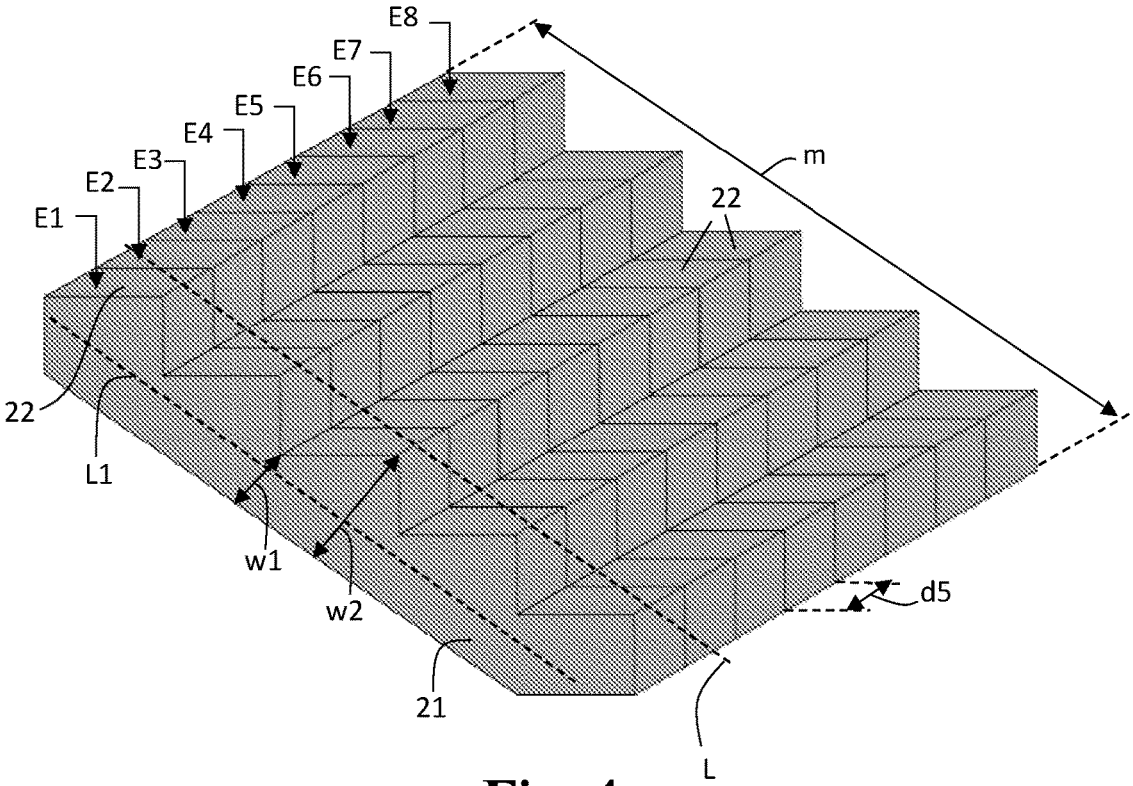
FIG. 4 shows a closed staircase assembled from eight marble staircase parts, in perspective view.

In FIG. 4 is represented a staircase which is assembled from eight identical staircase parts (E1)-(E8) made of beech wood. For the production of these staircase parts, a water jet cutting method without use of abrasive particles is adopted. The staircase parts are cut from a beam-shaped volume of beech wood having a uniform thickness (d5). As a result of their small width, the separate staircase parts are very light and easy to handle, whereby this staircase is easily transported and positioned by two persons.

The beech wood is here cut through over the full thickness (d5) in a direction perpendicular to the parallel surfaces which delimit the volume of oak wood.

Each staircase part (E1)-(E8) has an identical cross section in the longitudinal direction (L) and has two identical flat flanks (21), which extend parallel to one another, and a transverse surface (22) directed perpendicular to these flanks (21)—a cut surface—which, on the one side, forms five steps consisting of surfaces which adjoin one another at a right angle and, on the other side, a flat wall. The flanks (21) of each staircase part (E1)-(E8) have a transverse dimension (w1), (w2) perpendicular to the longitudinal direction (L1), which varies according to the longitudinal direction (L1) of the flank (1).

The staircase parts (C1), (C2) have a weight of 15 kg, so that these are easily movable by one or two persons.

The staircase parts are placed side by side at the construction site by two persons, with the flanks (21) butting one against another. All staircase parts (E1)-(E8) have practically the same width (d5). The staircase parts (E1)-(E8) are firmly connected to one another at the installation site by means of an epoxy glue to form a rigid and stable entity. In the thus assembled staircase, all staircase parts (E1)-(E8) extend according to the longitudinal direction (L) of the staircase over the entire length (m) thereof.

Finally, the staircase is also, at the top and bottom, anchored and integrated into the surrounding structure of the building.

The transverse surfaces (22) of the different staircase parts (E1)-(E8) here form uninterrupted strips, which side by side and butting one against another, extend on the top side and underside of the staircase over the entire length (m) of the staircase. As a result of the look of uninterrupted transverse surfaces (22)—cut surfaces—of beech wood staircase parts, which extend side by side over the entire length (m) of the staircase, a staircase having a particularly original look is obtained. Because the transverse surfaces (22) are cut surfaces and consequently have a look different from the surface of the flanks (1), which surfaces are not a cut surface, variation in the look of the staircase is obtained.

Moreover, all staircases represented in the figures are produced according to a fully automatable process at a relatively low production cost, wherein, for the concrete staircase parts, no formwork has to be provided.

The use of a water jet cutting method is here particularly advantageous and, moreover, allows the look of the cut surface to be altered by adapting the speed. Of course, the speed must also be determined as a function of the desired production speed and the desired quality of the cut surface. In addition, other parameters of the water cutting device must also be determined, such as, for example, the pressure of the water jet and the dimensions of the spray head, which are determinant for the flow velocity of the water jet and any abrasive particles. These parameters are determined empirically during one or more test productions.

The invention claimed is:

1. Method for producing a structural element which is assembled by joining together and connecting separately produced parts, wherein each of the separately produced parts, when assembled in the structural element, extends over an entire length of the structural element, and wherein at least one of the separately produced parts is made of concrete and at least one of the separately produced parts is made of a material other than concrete, comprising:

cutting each of the at least one concrete part from a volume of concrete.

2. Method for producing a structural element according to claim 1, wherein each part in the separately produced parts has two flanks extending according to the longitudinal direction of the structural element and having a varying transverse dimension.

3. Method for producing a structural element according to claim 1, wherein at least one part in the separately produced parts comprises a surface which runs visibly on a surface of the structural element and which is a partial surface of an outer surface of the structural element.

4. Method for producing a structural element according to claim 1, wherein each part in the separately produced parts comprises two practically flat flanks and is a slice of the structural element, which slice extends according to the longitudinal direction.

5. Method for producing a structural element according to claim 1, wherein at least one of the at least one of the separately produced parts made of a material other than concrete is made of one of the following materials: a stone material, a wood or wood-based material, a glass, a plexiglass, a metal, or a plastic.

6. Method for producing a structural element according to claim 1, wherein at least one part in the separately produced parts is made of a transparent material.

7. Method for producing a structural element according to claim 1, wherein the separately produced parts are connected to one another using a mechanical connecting element and/or a chemical bonding agent, wherein the mechanical connecting element and/or the chemical bonding agent is a silicon-based copolymer, an epoxy glue, or a polyurethane glue.

8. Method for producing a structural element according to claim 1, wherein the cutting each of the at least one concrete part from a volume of concrete comprises using a water jet cutting method.

9. Method for producing a structural element according to claim 1, further comprising producing each of the at least one of the separately produced parts made of a material other than concrete using a cutting method, and wherein the cutting method is a laser cutting method, a plasma cutting method, or a water jet cutting method.

10. Method for producing a structural element according to claim 1, wherein the structural element is a staircase, wherein at least each concrete part comprises a cut surface which is located on an upwardly directed surface of the staircase when the staircase is installed.

11. Method for producing a structural element according to claim 1, wherein the weight of each part in the separately produced parts is no higher than 80 kg.

12. Method for producing a structural element according to claim 1, wherein the at least one of the separately produced parts made of concrete comprises at least two concrete parts and wherein the at least one of the separately produced parts made of a material other than concrete comprises a metal part, further comprising providing the metal part between the at least two concrete parts.

13. Structural element comprising separately produced and mutually connected parts, wherein the mutually connected parts, when assembled in the structural element, extend over an entire length of the structural element, wherein at least one of the mutually connected parts is made of concrete, wherein each concrete part is cut from a volume of concrete using a cutting method, wherein at least one part in the mutually connected parts is made of a material other than concrete.

14. Structural element according to claim 13, wherein the material other than concrete comprises: a stone, a wood or wood-based material, glass, plexiglass, metal, or a plastic.

15. Structural element according to claim 13, wherein each part in the mutually connected parts comprises two flanks extending according to the longitudinal direction of the structural element and having a varying transverse dimension.

16. Structural element according to claim 13, wherein at least one part in the mutually connected parts comprises a surface which runs visibly on a surface of the structural element and which is a partial surface of the outer surface of the structural element.

17. Structural element according to claim 13, wherein each part in the mutually connected parts has two practically flat flanks and is a slice of the structural element, which slice extends according to the longitudinal direction.

18. Structural element according to claim 13, wherein at least one part in the mutually connected parts is made of a light-transmitting material.

19. Structural element according to claim 13, wherein the mutually connected parts are connected to one another by means of a mechanical connecting element and/or a chemical bonding agent, wherein the mechanical connecting element and/or the chemical bonding agent is a silicon-based copolymer, an epoxy glue, or a polyurethane glue.

20. Structural element according to claim 13, wherein the structural element is a staircase, wherein at least each concrete part has a cut surface which is located on the upwardly directed surface of the staircase.

21. Structural element according to claim 13, wherein the weight of each part in the mutually connected parts is no higher than 80 kg.

22. Structural element according to claim 13, wherein the mutually connected parts comprise a metal part between at least two concrete parts.

23. Method for producing a staircase which is assembled by joining together and connecting separately produced staircase parts, wherein the separately produced staircase parts, when assembled in the staircase, extend over an entire length of the staircase, and wherein the separately produced staircase parts comprises parts made of different materials, the different materials comprising a concrete material and one or more of: a stone material, a wood or wood-based material, a glass, a plexiglass, a metal, or a plastic, the method comprising:

cutting each staircase part made of concrete from a volume of material using a cutting method.

24. Method for producing a staircase according to claim 23, wherein each staircase part in the separately produced staircase parts has two flanks extending according to the longitudinal direction of the staircase.

25. Method for producing a staircase according to claim 24, wherein each staircase part in the separately produced staircase parts has two practically flat flanks and is a slice of the staircase, which slice extends according to the longitudinal direction.

26. Method for producing a staircase according to claim 23, wherein at least one staircase part in the separately produced staircase parts is made of a transparent material.

27. Method for producing a staircase according to claim 23, further comprising connecting the separately produced staircase parts to one another using a mechanical connecting element and/or a chemical bonding agent, wherein the mechanical connecting element and/or the chemical bonding agent is a silicon-based copolymer, an epoxy glue, or a polyurethane glue.

28. Method for the producing a staircase according to claim 23, wherein the cutting method is a laser cutting method, a plasma cutting method, or a water jet cutting method.

29. Method for producing a staircase, according to claim 23, wherein at least one staircase part in the separately produced staircase parts comprises a surface which, in the assembled staircase, runs visibly on a surface of the staircase and is a partial surface of the outer surface of the staircase.

30. Method for producing a staircase according to claim 23, wherein the weight of each staircase part in the separately produced staircase parts is no higher than 80 kg.

31. Method for producing a staircase according to claim 23, wherein the separately produced staircase parts comprise a metal staircase part between at least two concrete staircase parts.

32. Staircase comprising separately produced staircase parts, wherein the separately produced staircase parts, when assembled in the staircase, extend over an entire length of the staircase, wherein the separately produced staircase parts comprise parts made of different materials, and wherein the different materials comprise a concrete material and one or more of: a stone material, a wood or wood-based material, a glass, a plexiglass, a metal, or a plastic, wherein each staircase part made of concrete has been cut from a volume of material using a cutting method.

33. Staircase according to claim 32, wherein each staircase part in the separately produced staircase parts has two flanks extending according to the longitudinal direction of the staircase.

34. Staircase according to claim 33, wherein each staircase part in the separately produced staircase parts has two practically flat flanks and is a slice of the staircase, which slice extends according to the longitudinal direction.

35. Staircase according to claim 32, wherein at least one staircase part in the separately produced staircase parts is made of a light-transmitting material.

36. Staircase according to claim 32, wherein the separately produced staircase parts are connected to one another by a mechanical connecting element and/or a chemical bonding agent, wherein the mechanical connecting element and/or the chemical bonding agent is a silicon-based copolymer, an epoxy glue, or a polyurethane glue.

37. Staircase according to claim 32, wherein at least one staircase part in the separately produced staircase parts comprises a surface, which, in the assembled staircase, runs visibly on a surface of the staircase and is a partial surface of the outer surface of the staircase, wherein this partial surface traverses uninterruptedly at least the entire length of the structural element.

38. Staircase, according to claim 32, wherein each staircase part in the separately produced staircase parts comprises a cut surface which is visible on the top surface of the staircase placed in a usage position.

39. Staircase according to claim 32, wherein the weight of each staircase part in the separately produced staircase parts is no higher than 80 kg.

40. Staircase according to claim 32, wherein the separately produced staircase parts comprise a metal staircase part between at least two concrete staircase parts.

41. Method for producing a structural element according to claim 3, wherein each part in the separately produced parts comprises the surface.

42. Method for producing a structural element according to claim 8, wherein the water jet cutting method uses an abrasive.

43. Method for producing a structural element according to claim 11, wherein the weight of each part in the separately produced parts is no higher than 60 kg.

44. Method for producing a structural element according to claim 11, wherein the weight of each part in the separately produced parts is no higher than 50 kg.

45. Structural element according to claim 16, wherein each part in the mutually connected parts comprises the surface.

46. Structural element according to claim 21, wherein the weight of each part in the mutually produced parts is no higher than 60 kg.

47. Structural element according to claim 21, wherein the weight of each part in the mutually produced parts is no higher than 50 kg.

48. Method for producing a staircase, according to claim 29, wherein each staircase part in the separately produced staircase parts comprises the surface.

49. Method for producing a staircase according to claim 30, wherein the weight of each staircase part in the separately produced staircase parts is no higher than 60 kg.

50. Method for producing a staircase according to claim 30, wherein the weight of each staircase part in the separately produced staircase parts is no higher than 50 kg.

51. Staircase according to claim 37, wherein each staircase part in the separately produced staircase parts comprises the surface.

52. Staircase according to claim 39, wherein the weight of each staircase part in the separately produced staircase parts is no higher than 60 kg.

53. Staircase according to claim 39, wherein the weight of each staircase part in the separately produced staircase parts is no higher than 50 kg.

54. Method for producing a structural element according to claim 5, wherein the material other than concrete comprises a marble or a blue stone or a multiplex.

55. Structural element according to claim 14, wherein the material other than concrete comprises a marble or a blue stone or a multiplex.

56. Method for producing a staircase according to claim 23, wherein the different materials comprise a marble or a blue stone or a multiplex.

57. Staircase according to claim 32, wherein the different materials comprise a marble or a blue stone or a multiplex.

* * * * *